US005975682A

United States Patent [19]

Lee et al.

[11] Patent Number: 5,975,682

[45] Date of Patent: Nov. 2, 1999

[54] TWO-DIMENSIONAL FLUID DROPLET ARRAYS GENERATED USING A SINGLE NOZZLE

[75] Inventors: Eric R. Lee, Redwood City; Martin L. Perl, Palo Alto, both of Calif.

[73] Assignee: The Board of Trustees of the Leland Standford Junior University, Standford, Calif.

[21] Appl. No.: 08/908,333

[22] Filed: Aug. 7, 1997

Related U.S. Application Data

[60] Provisional application No. 60/023,500, Aug. 7, 1996.

[51] Int. Cl.[6] ..... B41J 2/07

[52] U.S. Cl. ..... 347/54; 239/102.2

[58] Field of Search ..... 239/4, 102.2, 135; 347/73, 74, 75, 76, 82, 47, 9, 10, 68; 345/54

[56] References Cited

U.S. PATENT DOCUMENTS

| | | | |
|---|---|---|---|
| 3,683,212 | 8/1972 | Zoltan | 347/47 |
| 5,171,360 | 12/1992 | Orme et al. | 75/331 |
| 5,226,948 | 7/1993 | Orme et al. | 75/331 |
| 5,560,543 | 10/1996 | Smith et al. | 239/102.2 |
| 5,700,692 | 12/1997 | Sweet | 436/50 |
| 5,810,988 | 9/1998 | Smith, Jr. et al. | 239/102.2 |

*Primary Examiner*—Huan Tran

*Attorney, Agent, or Firm*—Lumen Intellectual Property Services

[57] ABSTRACT

Amplitudes of drive pulses received by a horizontally-placed dropper determine the horizontal displacements of droplets relative to an ejection aperture of the dropper. The drive pulses are varied such that the dropper generates a two-dimensional array of vertically-falling droplets. Vertical and horizontal interdroplet spacings may be varied in real time. Applications include droplet analysis experiments such as Millikan fractional charge searches and aerosol characterization, as well as material deposition applications.

18 Claims, 2 Drawing Sheets

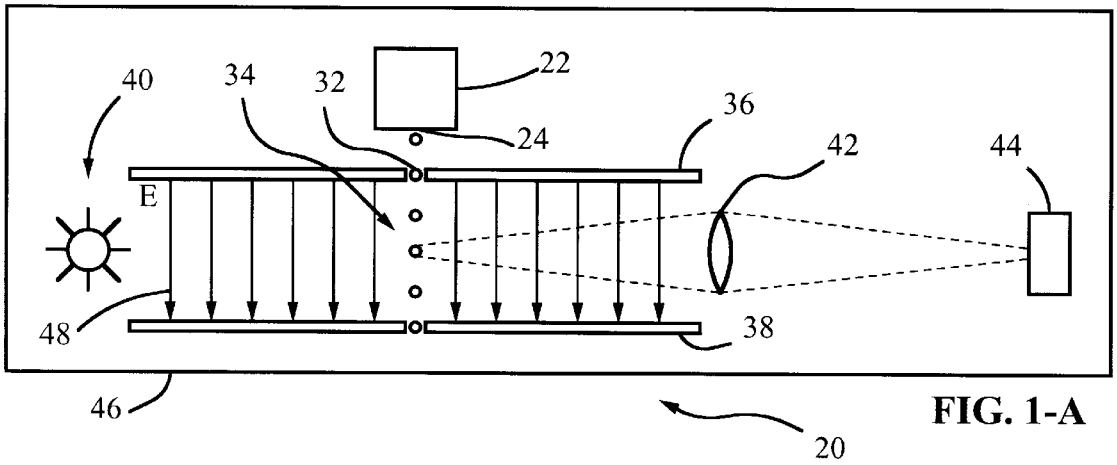
FIG. 1-A
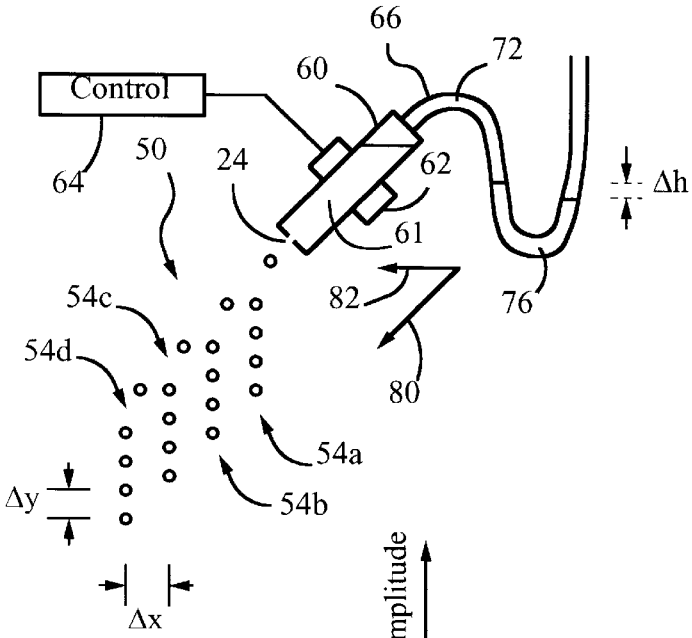
FIG. 1-B
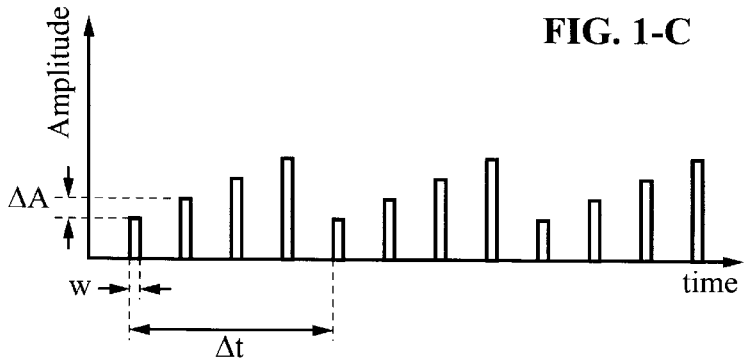
FIG. 1-C

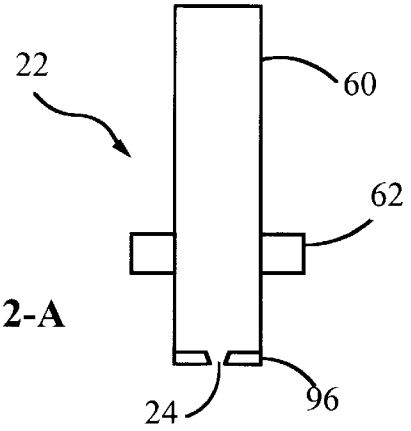
FIG. 2-A
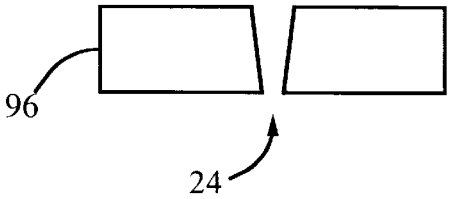
FIG. 2-B
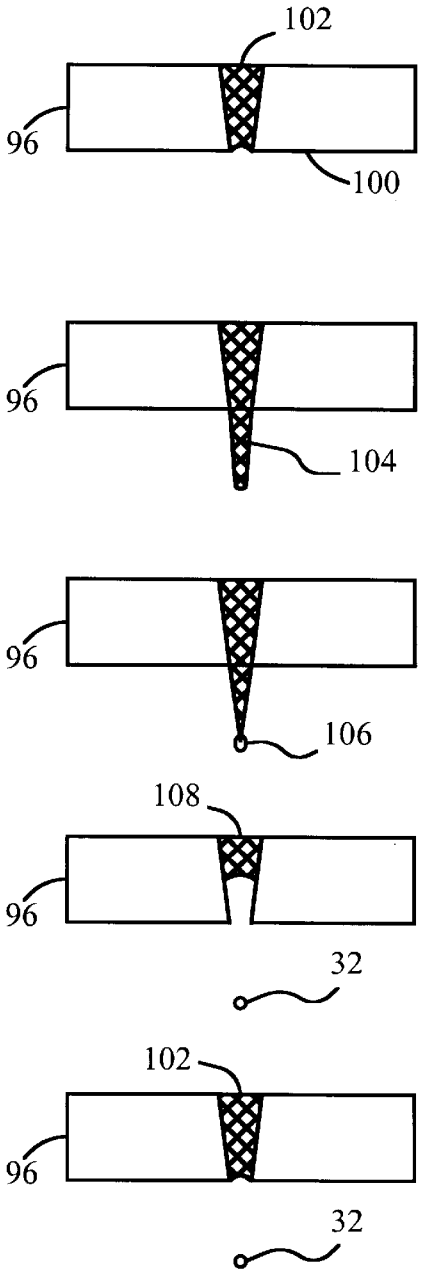
FIG. 3

TWO-DIMENSIONAL FLUID DROPLET ARRAYS GENERATED USING A SINGLE NOZZLE

RELATED APPLICATION DATA

This application is based on Provisional Patent Application No. 60/023,500, filed Aug. 7, 1996, which is herein incorporated by reference.

This invention was made with U.S. Government support under grant No. DE-AC-03-76SF00515, awarded by the Department of Energy. The U.S. Government has certain rights in this invention.

FIELD OF THE INVENTION

This invention relates to droplet generation and analysis devices, and in particular to an apparatus for generating two-dimensional droplet arrays using a single nozzle.

BACKGROUND OF THE INVENTION

Droplet generation devices are used in a variety of analysis and characterization applications such as fractional charge searches in particle physics and aerosol characterization in chemistry, as well as in material deposition applications such as inkjet printing and microfabrication.

Droplet generators used in conventional analysis applications typically consist of a vertical dropper situated above an analysis chamber. The dropper generates a vertical stream of droplets which is optically analyzed as it falls through the analysis chamber. Depending on the application, the droplets may be subjected to electric fields, air currents, or other perturbations. For examples of droplet generators used for fractional charge searches see the article by Savage et al. in *Phys. Lett.* 167(B4):481 (1986), as well as the M.S. thesis of Joyce, San Francisco State University (1985).

Desirable properties for droppers used in analysis applications include: ability to adjust droplet sizes either electronically or by replacing a minimal amount of hardware, ease of replacement for droplet nozzles, chemical inertness of all tubing (including nozzle), and ability to generate a large number of analyzable droplets within the field of view of an analysis camera. Using a single nozzle for drop generation is desirable since it allows a significant reduction in total system cost, and in particular in nozzle replacement costs. Typical prior art single-nozzle systems are limited to generating a single stream of droplets, however, and therefore can only provide a limited amount of data within a given field of view of a camera.

Droplet generators used in conventional material deposition applications such as inkjet printing typically consist of a linear array of vertical nozzles situated closely above the deposition target (e.g. a sheet of paper). Each nozzle ejects droplets at a fixed location as the target moves relative to the array. The dropper array may be used to generate two-dimensional droplet arrays. The requirement for placing the nozzles in close proximity to the target makes imaging the impact points of the droplets relatively difficult. For information on droplet generators used for inkjet printing see for example U.S. Pat. Nos. 5,124,716, 3,683,212, and 5,619,234.

OBJECTS AND ADVANTAGES OF THE INVENTION

In light of the above, it is a primary object of the present invention to provide a droplet analysis apparatus capable of using a single nozzle to generate a large amount of analyzable data within the field of view of an analysis camera. It is another object of the invention to provide an apparatus capable of modulating in real time the vertical and horizontal interdroplet spacings of a two-dimensional droplet array. It is another object of the invention to provide a deposition system allowing for easy visualization of droplet impact points on deposition targets.

SUMMARY OF THE INVENTION

The present invention provides an improved apparatus for generating droplets. The apparatus comprises a liquid reservoir, an ejection means coupled to the reservoir, and a control means in electrical communication with the ejection means, for controlling the ejection means. The liquid reservoir has an ejection aperture for ejecting liquid droplets along an ejection direction having a horizontal component. The ejection means generates pressure pulses within the reservoir such that the reservoir ejects droplets through the ejection aperture. The pressure pulses, and in particular their amplitudes, determine horizontal displacements of the droplets relative to the ejection aperture. The pressure pulses are controlled by drive pulses generated by the control means and received by the ejection means. The control means generates drive pulses of various amplitudes, such that the reservoir ejects droplets of various horizontal displacements.

DESCRIPTION OF THE FIGURES

FIG. 1-A shows a side view of a preferred apparatus including a dropper of the present invention.

FIG. 1-B shows the dropper of FIG. 1-A and a two-dimensional droplet array generated by the dropper, in a side view orthogonal to the view of FIG. 1-A.

FIG. 1-C shows a driving pulse sequence used to generate part of the droplet array of FIG. 1-B.

FIG. 2-A shows a longitudinal sectional view of the dropper of FIG. 1-B.

FIG. 2-B shows a longitudinal sectional view of the aperture plate of the dropper of FIG. 2-A.

FIG. 3 shows the aperture plate of FIG. 2-B as a droplet is ejected through the dropper aperture.

DETAILED DESCRIPTION

FIG. 1-A shows a side schematic view (not to scale) of a preferred apparatus 20 of the present invention, suitable for droplet analysis applications and in particular for charge measurement (e.g. Millikan oil drop) experiments. Apparatus 20 comprises a dropper 22 having an ejection aperture 24 for ejecting liquid droplets 32. Ejection aperture 24 is situated above aligned slits in an upper plate 36 and lower plate 38. Upper plate 36 and lower plate 38 are parallel and horizontal, and are connected to a voltage source (not shown) for generating a potential difference between upper plate 36 and lower plate 38. The space between upper plate 36 and lower plate 38 comprises an analysis area 34. A housing 46 defines a convection-free enclosure comprising analysis area 34, such that the trajectories of droplets 32 are not affected by air currents. A light source 40, preferably a strobe, is positioned laterally with respect to analysis area 34, and is capable of illuminating analysis area 34. A CCD camera 44 and imaging optics (including a lens 42) are situated opposite light source 40 relative to analysis area 34, such that droplets 32 within analysis area 34 are imaged onto camera 44. Light source 40, dropper 22, and camera 44 are in electrical communication with control electronics (not shown) situated outside housing 46.

A potential difference between upper plate 36 and a lower plate 38 generates a uniform vertical electric field 48 within analysis area 34. Electric field 48 oscillates in time as a square wave with a non-zero time average. Droplets 32 enter and exit an analysis area 34 through slits in upper plate 36 and lower plate 38. Droplets 32 within analysis area 34 are illuminated by light source 40 and are imaged through lens 42 onto CCD camera 44. The vertical displacements of droplets 32 are indicative of the electric charge on droplets 32.

FIG. 1-B shows dropper 22 and a two-dimensional droplet array 50 generated by dropper 22, from a side view orthogonal to the view of FIG. 1-A. Dropper 22 comprises a fluid reservoir having a side wall 60. An ejection means 62 is coupled to side wall 60 and laterally encloses side wall 60. Ejection means 62 comprises a piezoelectric disk for constricting side wall 60. Ejection means 62 is in electrical communication with control electronics 64. Ejection means 62 constricts the fluid reservoir in response to the drive pulses, generating pressure pulses within the fluid reservoir. The pressure pulses cause the ejection of the droplets forming array 50.

A connection tube 66 is connected to the fluid reservoir at the end opposite aperture 24, for controlling the global pressure within the fluid reservoir. Connection tube 66 is further connected to a manometer 68 at the end opposite the fluid reservoir. Tube 66 encloses an inert gas volume 72 adjacent to the fluid reservoir, a connection gas volume 74 adjacent to manometer 68, and a U-shaped liquid column 76 between inert gas 72 and connection gas 74. The inert gas may be any gas which does not react with the liquid to be ejected; depending on the application, the inert gas may be air or a noble gas. Manometer 68 is used to apply a slightly negative pressure to connection gas 74, which causes a level difference $\Delta h$ between the two surfaces of column 76, which in turn causes a slightly negative pressure to be applied to the liquid reservoir. The negative pressure prevents the escape of liquid through aperture 24 in the absence of a drive pulse. Meniscus buildup and subsequent liquid escape is also impeded by the horizontal orientation of dropper 22. Liquid escape can cause wetting of the surface surrounding aperture 24.

Droplets 32 are ejected through aperture 24 along an ejection direction 80 having a horizontal component 82. The ejection direction is preferably at approximately 45° from the horizontal; alternatively, the ejection direction may be horizontal. Shortly after ejection, the horizontal velocities of droplets 32 are dampened by air friction, and droplets 32 fall vertically downward with a constant velocity determined by Stokes' Law. For droplets having non-zero charge, the terminal velocity depends on whether electric field 48 opposes or reinforces the gravitational force on the droplets. The two-dimensional droplet array 50 generated by dropper 22 comprises a rectangular array portion consisting of parallel falling droplet streams 54*a–d*. Streams 54*a–d* are separated by horizontal interdroplet spacings $\Delta x$, while droplets within a single stream are separated by vertical interdroplet spacings $\Delta y$.

The horizontal and vertical interdroplet spacings are controlled by the drive pulses received by ejection means 62. FIG. 1-C illustrates three consecutive sequences of drive pulses generated by control means 64 and received by ejection means 62. The vertical interdroplet spacing between two consecutive droplets in a vertical stream is determined by the time difference $\Delta t$ between the drive pulses corresponding to the two droplets. The horizontal spacing between droplets in adjacent streams is determined by the difference in amplitude $\Delta A$ between the drive pulses corresponding to the two streams. The pulse width of the pulses is marked w. The drive pulse amplitudes determine the initial horizontal droplet velocities and the location of the droplet break-off points (see below), thus determining the horizontal droplet displacements at any given time point.

FIG. 2-A is a longitudinal sectional view of dropper 22, showing ejection means 62 and side wall 60. Side wall 60 is preferably a brass cylinder, while ejection means 62 preferably comprises an annular piezoelectric transducer disk made from lead zirconate titanate, and attached to side wall 60 with epoxy. An aperture plate 96 comprising aperture 24 is preferably made of stainless steel, and is attached to the bottom of side wall 60 by epoxy. FIG. 2-B shows a longitudinal cross section of aperture plate 96. Aperture 24 has tapered side walls, such that aperture 24 is broader on the top side of aperture plate 96 and narrower on the bottom (ejection) side of aperture plate 96.

In an alternative embodiment particularly suited for analysis of chemically reactive liquids, side wall 60 is made of quartz, which is chemically inert to most substances including strong acids and bases. Ejection means 62 is attached to side wall 60 by industrial grade epoxy or another high-strength adhesive. Aperture plate 96 is a cut piece of a silicon wafer, with aperture 24 having a pyramidal or conical shape defined by micromachining. The bottom of side wall 60 is optically flat, and is connected to the silicon dioxide layer on the top of aperture plate 96 by fusion bonding at 600 ° C. The use of micromachined silicon greatly simplifies the manufacture of dropper 22. The combined use of silicon and quartz (both chemically inert) in the absence of metal, plastics, or adhesives in contact with the fluid allows the ejection of high-temperature fluids, corrosives, and biological samples requiring high sterility.

FIG. 3 illustrates aperture plate 96 as a droplet is generated by dropper 22. A liquid volume 102 is initially in a resting state within aperture 24. Slightly negative pressure acting on liquid volume 102 maintains liquid volume 102 within aperture 24, and prevents the wetting of a bottom surface 100 of aperture plate 96. As a pressure pulse is applied by ejection means 62, a liquid extension stretches outward from aperture 24. A droplet precursor 106 forms as liquid starts retracting toward aperture 24. Droplet precursor 106 becomes a drop 32 as liquid 108 is fully retracted in aperture 24, as a result of the negative pressure wave caused by the relaxation of ejection means 62. The breaking point of droplet 32 is determined by the amplitude of the drive pulse received by ejection means 62. During the retraction of the fluid, air does not become trapped within aperture 24. Liquid from the fluid reservoir of dropper 22 then enters aperture 96 from the top, restoring the resting-state liquid volume 102.

Generating clean droplets (without spray) of uniform and small (~10 $\mu$m) size typically requires optimizing regime parameters for dropper 22. To optimize system settings, a drive pulse amplitude corresponding generally to desired horizontal displacements is selected. The drive pulse width is varied until dropper 22 produces clean drops of uniform size. The drive pulse amplitude is then varied for a fixed pulse width setting to find the operating amplitude range in which dropper 22 does not produce spray. If the operating amplitude range is not satisfactory for attaining desired horizontal interdroplet spacings, the drive pulse width is again varied to a point corresponding to clean droplets. The pulse rise- and fall-times, and the instantaneous pressure applied by manometer 68 also affect droplet stability, and may all be varied during the optimization procedure. For a double pulse technique, in which each drive pulse consists of two closely separated (hundreds of microseconds) spikes, the interspike separation may also be varied in the initial optimization step, until clean drops are generated.

The present invention does not require that the force field acting on the droplets be vertical. More generally, a field (e.g. a combined electric and gravitational field) of arbitrary direction may be used to apply a force on the droplets. The ejection direction then has a component along an orthogonal direction orthogonal to the applied field. Pressure pulses then determine droplet displacements along the orthogonal direction, relative to the ejection aperture.

A dropper of the present invention is not limited to droplet analysis applications, and may be used for material deposition applications. In such applications, a position adjustment means may be used to adjust the dropper position relative to a target deposition area. The position adjustment means may include a x-y or linear stage on which the dropper is mounted, and/or a rotational means allowing rotation of the dropper about vertical and/or horizontal axes.

Applications of the present invention include the generation of aerosols for their study, weighing macromolecules incorporated in the droplets, microfabrication by accretion of material contained within the droplets, optical analysis of materials, and analysis of convection patterns.

The following example is intended to illustrate a particular embodiment of the invention, and should not be construed to limit the invention.

EXAMPLE

Suitable parameters for an apparatus such as apparatus 22 include: maximum amplitude of $1.4\times10^6$ V/m for electric field 48; inside diameter of 4.8 mm, wall thickness of 1.6 mm, and length of 6.4 cm for side wall 60; inside diameter of 6.4 mm, outside diameter of 25.4 mm, and thickness of 2.5 mm for piezoelectric disk 62; 9.5 mm diameter for aperture plate 96; 8 $\mu$m diameter for aperture 24; and drive voltages from 130 V to 160 V, with drive pulse widths from 0.85 $\mu$s to 1.2 $\mu$s. Using such a device, clean droplets of highly controlled diameters between 7 and 8 $\mu$s were generated.

It will be clear to one skilled in the art that the above embodiments may be altered in many ways without departing from the scope of the invention. For example, droplet horizontal displacements need not be controlled by varying drive pulse amplitudes, but may generally be controlled by varying pulse widths or other parameters. Suitable droplet sizes range from about 5 $\mu$m to about 100 $\mu$m. While droplet sizes are defined to some extent by ejection aperture diameters, pulse widths and amplitudes may be used to vary droplets sizes droplet sizes within a factor of two of the aperture diameter. While a piezoelectric ejection means is desirable because of its low cost, low heat generation, low power requirements, and ease of integration with the fluid reservoir, other ejection means may generally be used in the present invention. Suitable ejection means may include devices using acoustic excitation from focused ultrasound, electrostatic constriction or repulsion, electromagnetic actuation, electrothermal pulse generation, or purely mechanical or pneumatic methods of generating pressure pulses. Accordingly, the scope of the invention should be determined by the following claims and their legal equivalents.

What is claimed is:

1. An apparatus for generating droplets, comprising:

a) a liquid reservoir having an ejection aperture for ejecting liquid droplets along an ejection direction having a horizontal component;

b) an ejection means coupled to said reservoir, for generating pressure pulses within said reservoir such that said reservoir ejects said droplets through said ejection aperture, wherein said pressure pulses determine horizontal displacements of said droplets, relative to said ejection aperture; and c) a control means in electrical communication with said ejection means, for sending drive pulses to said ejection means to produce said pressure pulses such that said reservoir ejects droplets of a plurality of horizontal displacements.

2. The apparatus of claim 1 wherein said control means controls said drive pulses such that said apparatus generates a two-dimensional droplet array.

3. The apparatus of claim 2 wherein said droplet array is a rectangular array.

4. The apparatus of claim 2 wherein said control means is capable of adjusting timings and amplitudes of said drive pulses for adjusting vertical and horizontal interdroplet spacings of said droplet array.

5. The apparatus of claim 1 wherein said horizontal displacements are determined substantially by corresponding amplitudes of said drive pulses.

6. The apparatus of claim 1 wherein a size of said ejection aperture is on the order of 10 $\mu$m, such that a diameter of said droplets is on the order of 10 $\mu$m.

7. The apparatus of claim 6 wherein said size is less than 10 $\mu$m, such that said diameter is less than 10 $\mu$m.

8. The apparatus of claim 1 wherein said reservoir comprises:

a) a side wall, said ejection means laterally enclosing said side wall for constricting said side wall to generate said pressure pulses; and b) an aperture plate bonded to said side wall, said aperture plate comprising said ejection aperture.

9. The apparatus of claim 1 wherein said ejection means comprises a piezoelectric device laterally enclosing said reservoir, for constricting said reservoir to generate said pressure pulses.

10. The apparatus of claim 1 further comprising a manometer coupled to liquid in said reservoir, for controlling a global pressure in said reservoir.

11. The apparatus of claim 10 wherein said manometer is coupled to said liquid in said reservoir through:

a gas coupled to said liquid in said reservoir, and a movable liquid column coupled to said gas, a height of said column determining a pressure of said gas, said manometer being coupled to said liquid column.

12. The apparatus of claim 1 further comprising a convection-free chamber enclosing said ejection aperture and said droplets, whereby trajectories of said droplets are substantially unaffected by convection.

13. The apparatus of claim 1 further comprising:

a) a light source for illuminating said droplets; and b) a camera for recording images of said droplets.

14. The apparatus of claim 1 further comprising a position adjustment means for adjusting a position of said ejection aperture relative to a droplet target.

15. An apparatus for generating droplets, comprising:

a) a liquid reservoir having an ejection aperture for ejecting liquid droplets along an ejection direction having a horizontal component;

b) an ejection means coupled to said reservoir, for generating pressure pulses within said reservoir such that said reservoir ejects said droplets through said ejection aperture, wherein said pressure pulses determine locations of breaking points of said droplets, relative to said ejection aperture; and c) a control means in electrical communication with said ejection means, for energizing said ejection means to produce periodic sequences of said pressure pulses such that said apparatus generates a plurality of parallel falling droplet streams.

16. An apparatus for generating droplets, comprising:

a) a field means for generating a field;

b) a liquid reservoir having an ejection aperture for ejecting liquid droplets along an ejection direction having a component along an orthogonal direction, said orthogonal direction being orthogonal to a direction of a force exerted by said field on said droplets;

c) an ejection means coupled to said reservoir, for generating pressure pulses within said reservoir such that said reservoir ejects said droplets through said ejection aperture, wherein said pressure pulses determine displacements of said droplets along said orthogonal direction, relative to said ejection aperture; and d) a control means in electrical communication with said ejection means, for sending drive pulses to said ejection means to produce said pressure pulses such that said reservoir ejects droplets of a plurality of displacements along said orthogonal direction.

17. A method of generating a two-dimensional droplet array, comprising the steps of:

a) generating a first pressure pulse for ejecting a first droplet through an ejection aperture, along an ejection direction having a horizontal component;

b) electronically controlling in real time said first pressure pulse such that said first droplet has a first horizontal displacement relative to said ejection aperture;

c) generating a second pressure pulse for ejecting a second droplet through said ejection aperture, along said ejection direction; and d) electronically controlling in real time said second pressure pulse such that said second droplet has a second horizontal displacement relative to said ejection aperture, wherein said second horizontal displacement is distinct from said first horizontal displacement.

18. A method of generating a two-dimensional droplet array, comprising the steps of:

a) generating pressure pulses within a liquid reservoir having an ejection aperture, such that said reservoir ejects droplets through said ejection aperture along an ejection direction having a horizontal component, wherein said pressure pulses determine horizontal displacements of said droplets, relative to said ejection aperture; and b) controlling said pressure pulses such that said reservoir ejects droplets of a plurality of horizontal displacements.

* * * * *

UNITED STATES PATENT AND TRADEMARK OFFICE

CERTIFICATE OF CORRECTION

PATENT NO. : 5,975,682 
APPLICATION NO. : 08/908333
DATED : November 2, 1999
INVENTOR(S) : Eric R. Lee and Martin L. Perl It is certified that error appears in the above-identified patent and that said Letters Patent is hereby corrected as shown below:

On Title Page (item 73)
On Page 1 of the Patent Grant, please correct the Assignee of Entire Interest of Patent from "The Board of Trustees of the Leland Standford University" to
--The Board of Trustees of the Leland Stanford University--.

Signed and Sealed this

Twenty-fourth Day of October, 2006

JON W. DUDAS
*Director of the United States Patent and Trademark Office*